US006488284B2

(12) United States Patent
Webb

(10) Patent No.: US 6,488,284 B2
(45) **Date of Patent: *Dec. 3, 2002**

(54) METHOD AND APPARATUS FOR PLAYING A GAME WITH NUMERICAL RESULT

(75) Inventor: Derek J. Webb, Derby (GB)

(73) Assignee: Prime Table Games LLC, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/841,174

(22) Filed: Apr. 25, 2001

(65) Prior Publication Data

US 2001/0035609 A1 Nov. 1, 2001

Related U.S. Application Data

(63) Continuation-in-part of application No. 09/389,480, filed on Sep. 3, 1999, now Pat. No. 6,241,250, which is a continuation-in-part of application No. 09/351,330, filed on Jul. 12, 1999, now Pat. No. 6,164,651.

(51) Int. Cl.[7] ..... A63F 1/00
(52) U.S. Cl. ..... 273/274; 273/292; 463/12
(58) Field of Search ..... 273/274, 303, 273/292; 463/12, 13

(56) References Cited

U.S. PATENT DOCUMENTS

| | | | | |
|---|---|---|---|---|
| 4,252,321 A | | 2/1981 | Hopwood | |
| 5,257,810 A | * | 11/1993 | Schorr et al. | 273/274 |
| 5,362,064 A | * | 11/1994 | Lofink et al. | 273/274 |
| 5,395,119 A | * | 3/1995 | Jacob et al. | 273/274 |
| 5,529,309 A | * | 6/1996 | Bartlett | 273/292 |
| 5,839,731 A | * | 11/1998 | Feola | 273/292 |
| 6,065,753 A | * | 5/2000 | Morosky | 273/292 |
| 6,237,917 B1 | * | 5/2001 | Timpano | 273/292 |

* cited by examiner

*Primary Examiner*—Benjamin H. Layno
(74) *Attorney, Agent, or Firm*—Nixon & Vanderhye P.C.

(57) ABSTRACT

A Baccarat derivation incorporates an adjustable house advantage while eliminating confusing card-drawing rules, resulting in a more exciting and playable game. A table layout includes betting areas for a competition wager that one side or the other will win the game as well as a proposition wager area that the sides will tie. As with conventional Baccarat, the players can wager for either side. The methodology is suited for any game where a result is determined according to ranked values such as Baccarat, Blackjack, War or Dice.

26 Claims, 2 Drawing Sheets

METHOD AND APPARATUS FOR PLAYING A GAME WITH NUMERICAL RESULT

CROSS-REFERENCES TO RELATED APPLICATIONS

This application is a continuation-in-part (CIP) of U.S. patent application Ser. No. 09/389,480, filed Sep. 3, 1999 now U.S. Pat No. 6,241,250 which is a CIP of U.S. patent application Ser. No. 09/351,330, filed Jul. 12, 1999, now U.S. Pat. No. 6,164,651, the entire contents of which are hereby incorporated by reference in this application.

STATEMENT REGARDING FEDERALLY SPONSORED RESEARCH OR DEVELOPMENT (NOT APPLICABLE)

BACKGROUND OF THE INVENTION

The present invention relates to casino games and gaming formats and, more particularly, to betting options and modified versions of existing games where a result is determined according to ranked values.

Baccarat is played internationally with different rules and different names, such as Punto Banco and Chemin-de-Fer. In the U.S., Baccarat is typically played in a dedicated VIP high-stakes gaming area. In an effort to increase the popularity of the game, smaller versions of Baccarat such as Mini-Baccarat have been introduced in the regular gaming area.

There are several drawbacks associated with conventional Baccarat. In particular, in certain situations, the house takes a commission on wagers. Although the house needs an advantage, the use of commission can deter many players. Moreover, from a casino perspective, calculating commissions slows down the game. To correct this, the game may be operated where the commission is collected not after each hand, but at the end of each shoe (a shoe holds multiple decks of cards from which hands are dealt by the dealer), prior to reshuffling the decks. While this speeds up the game, collection of commission may be impacted by the player running out of funds or not wishing to meet the obligation.

Moreover, for novice players, the rules of play seem obscure, and the procedure is prone to error. In Baccarat, there is a player hand and a banker hand, but the casino player may bet either hand. Each hand receives two cards with 10's and face cards counting as zero. The superior hand is the higher hand, with 9 being the highest total and with each hand being allowed to draw a third card in certain circumstances. The card draw option to the player hand is determined by the player two-card total, and the card draw option to the banker hand is determined by the banker two-card total and the exact third card drawn by the player. With these rules, although the game is simple in its concepts, the game has a complicated appearance.

Still further, with conventional Baccarat, there is an inherent hand-value deterioration bias. That is, a two-card total of 5 improves with a 1, 2, 3 or 4 value card, but deteriorates with a 5, 6, 7, 8 or 9 value card, which creates the inherent bias.

Additionally, as a tie is a push with respect to wagers, there is no casino advantage working on the player and banker wagers when a tie occurs. If the tie outcome could be incorporated into the outcome of the basic wager, the house advantage could be manipulated as desired.

In one modified version of Baccarat, so called Bahama Baccarat or No Commission Baccarat, the commission aspect has been successfully removed. The house advantage is incorporated in a bar rule so a specific result is determined differently than with conventional Baccarat. In this context, however, the game retains a complicated draw process, does not offer higher payoffs, the tie is a non-result, and the bar rule gives an impression of a lack of balance.

BRIEF SUMMARY OF THE INVENTION

There is thus a need for a Baccarat variant that not only removes the commission aspect of the game, but also eliminates card drawing complications, incorporates a house advantage in the tie result, and removes the inherent deterioration bias in conventional Baccarat. With such a Baccarat variant, the game would be simple to operate and attractive to new players.

According to the present invention, a Baccarat variant is a simplified version of the conventional game, incorporating player hand win or banker hand win bet options as well as a tie bet option. The methodology according to the invention can be applied to other ranked value games such as Blackjack, War, Dice or an original ranked value game.

According to a particular aspect of the invention, there is provided a method of playing a game where a result is determined according to ranked values. The method includes the steps of (a) receiving at least one wager that at least one of a plurality of events will occur, the plurality of events including (1) a first side having a higher ranking value than a second side, (2) the second side having a higher ranking value than the first side, and (3) the first side having a ranking value equal to the second side; (b) adjusting a house advantage by determining rules for resolving ties; (c) dealing two playing cards to each of the first side and the second side and determining a numerical total of each of the two playing cards according to predetermined rules of the game; and (d) resolving the at least one wager according to the respective numerical totals and the rules for resolving ties, wherein upon the occurrence of a tie, wagers for events (1) and (2) are pushed except for ties with a numerical value of zero. In this context, upon the occurrence of a zero tie, step (d) may be practiced by taking wagers on events (1) and (2); taking wagers on events (1) and (2) when the zero tie results from two zero-value cards for each of the first side and the second side and by paying 1 to 1 on wagers for events (1) and (2) when the zero tie results from any other combination of cards; taking half of the wagers on events (1) and (2); or holding wagers on events (1) and (2) for a next deal of cards, and resolving the wagers on events (1) and (2) in the next deal of cards.

The wagers on events (1) and (2) held according to step (d) may be resolved in the next deal of cards according to the following:

(i) if the first side wins the next deal of cards, wagers on event (1) are returned and wagers on event (2) are taken;

(ii) if the second side wins the next deal of cards, wagers on event (2) are returned and wagers on event (1) are taken; and (iii) if a result of the next deal of cards is a tie, then the wagers on events (1) and (2) are resolved according to special rules.

The special rules may comprise paying a payout on the held wagers for events (1) and (2); taking the held wagers for events (1) and (2); pushing the held wagers for events (1) and (2); or further holding the held wagers for events (1) and (2) for another deal of cards.

Step (d) may alternatively be practiced by paying 1 to 1 on wagers for events (1) and (2) when the respective numerical totals tie with 2, 4, 6 or 8, taking wagers on events (1) and (2) when the respective numerical totals tie with 1, 3, 5, 7 or 9, and pushing wagers on events (1) and (2) when the respective numerical totals tie with zero.

According to another particular aspect of the invention, an apparatus for playing a game where a result is determined according to ranked values includes structure for carrying out the method of the invention.

According to still another aspect of the invention, there is provided a method of playing a game where a result is determined according to ranked values. The method includes the steps of (a) receiving at least one wager that at least one of a plurality of events will occur, the plurality of events including (1) a first side having a higher ranking value than a second side, (2) the second side having a higher ranking value than the first side, and (3) the first side having a ranking value equal to the second side; (b) dealing two playing cards to each of the first side and the second side and determining a numerical total of each of the two playing cards according to predetermined rules of the game; and (c) resolving the at least one wager according to the respective numerical totals, wherein upon the occurrence of a tie, wagers for events (1) and (2) are pushed except for ties with a numerical value of zero, wherein upon the occurrence of a zero tie, step (c) is practiced by one of taking wagers on events (1) and (2), taking wagers on events (1) and (2) when the zero tie results from two zero-value cards for each of the first side and the second side and paying 1 to 1 on wagers for events (1) and (2) when the zero tie results from any other combination of cards, taking half of the wagers on events (1) and (2), and holding wagers on events (1) and (2) for a next deal of cards, and resolving the wagers on events (1) and (2) in the next deal of cards.

BRIEF DESCRIPTION OF THE DRAWINGS

These and other aspects and advantages of the present invention will be described in detail with reference to the accompanying drawings, in which.

DETAILED DESCRIPTION OF THE INVENTION

Figure 1:
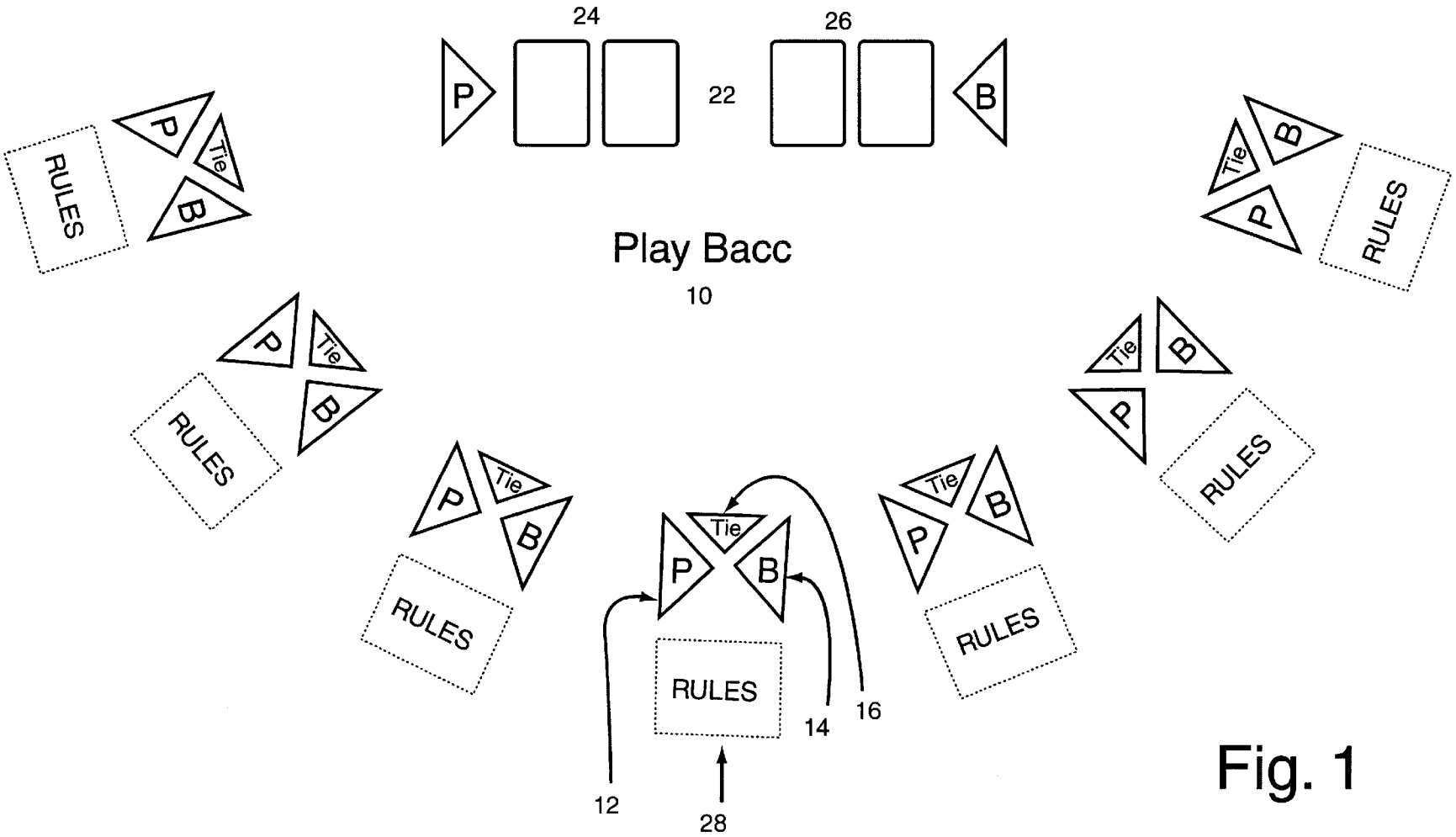
FIG. 1 is a plan view of a table arrangement according to the present invention.

FIG. 1 illustrates a playing surface or table layout 10 on which an embodiment of the invention may be played. The game according to the invention is preferably played on a semi-circular-shaped table including a host or dealer and game equipment for establishing results for a first side such as a player designated "P" and a second side such as a banker designated "B." In conventional Baccarat, one hand is designated as a player hand, and the other hand is designated as a banker hand. Participants in the game, however, can bet either for the player hand or the banker hand, which is the source of some confusion. To eliminate this confusion, according to the invention, the hands are referred to as a first side and a second side or as "P" and "B."

As shown in FIG. 1, the preferred layout includes multiple betting areas 12, 14 and 16 for one or a plurality of players. The betting areas include competition wager areas 12, 14 for simple bets that either the first side will win the hand or the second side will win the hand and a proposition wager area 16. The layout 10 also includes a dealer area 22 having two hand areas 24, 26 for the first side hand and the second side hand, respectively, and a rules area 28 setting forth one or more rules of the game.

In a preferred embodiment, the game equipment includes one or more standard decks of playing cards, such as four or eight decks, with or without picture cards being removed. In a standard deck of playing cards, picture cards include playing cards having an indicia of a King, a Queen or a Jack. The deck used in the game may be a conventional collection of multiple packs of 52 cards or alternatively a deck of 10 packs of 40 cards each with the picture cards removed. Similar to conventional Baccarat, aces count as 1, 10 cards count as zero, and 10 values in totals (e.g., a 3 card and a 7 card in a two-card hand) also count as zero. Whichever deck is used, each hand may be a two-card or three-card hand depending on the version in operation. Once the hands are dealt, there is no draw of cards thus eliminating errors, confusion and the inherent hand-deterioration bias. In a preferred embodiment, each side receives two cards, one each in alternating order.

Each player may place a bet for either side in the competition wager area 12, 14 and also may make a tie proposition bet in the proposition wager area 16. Although any rules concerning hand totals and the like can be adopted, the preferred rules for determining the winning hand preferably correspond with the rules of conventional Baccarat. That is, the hand having a higher numerical total closest to 9 is the winner.

The competition wager in areas 12 and 14 is a wager that one side or the other will win the game and preferably pays 1 to 1 . A house advantage can be created with this bet for situations where the first side hand numerical total is equal to the second side hand numerical total. For example, all tied hands typically result in a pushed wager except for a tie on one or more specific numbers such as zero in which the house wins. With regular decks, zero ties may be determined as ties, losses or wins dependent upon whether the zero totals include 10-value cards. Alternatively, all P and B bets may win when the tie is on any of a set of numbers, such as ODD numbers, whereas all P and B bets lose when the tie is on any of an alternative set of numbers, such as EVEN numbers, with an option for any specific numbers such as zero to be a tie or be included with either set. The house advantage changes with different sets of numbers, so a variety of sets with alternative sets may be viable. As such, the house advantage can be adjusted by determining rules with respect to resolving ties. For example, all bets in the competition wager areas 12, 14 may be paid 1 to 1 when the hands tie with a numerical total of 1, 3, 5, 7 or 9, and all bets lose on a tie with a numerical total of 0, 2, 4, 6 or 8. One viable operating mode of this version with two or three decks of cards provides that all competition wagers 12, 14 win when the hands tie with a numerical total of 2, 4, 6 or 8 and all competition wagers 12, 14 lose when the hands tie with a numerical total of 1, 3, 5, 7 or 9. The competition wagers 12, 14 are pushed with a zero tie. In another variation, the groups could be 1, 2, 3, 4 and 5, 6, 7, 8, 9, respectively, each with or without zero included or a zero value tie may be considered a push. Of course, many alternatives can be contemplated in this scenario.

In one alternative operating embodiment, all ties are pushed with the exception of a tie with a numerical total of zero. In the event of a zero tie, in a first version, the house wins all P and B bets. In a second version, if the zero tie results from four zero value cards, the house wins all P and B wagers. All other zero ties are deemed wins for the P and B wagers with a fixed payout such as 1 to 1. In a third version, in the event of the zero tie, all P and B wagers lose only a certain percentage of the wagered amount, such as 50%.

Finally, in a fourth version, upon the occurrence of a zero tie, the P and B wagers stay "en prison," wherein all P and B "en prison" bets are topped with a dealer button or like identifier, and all P and B bets must stay in action. If the next deal results in a P win, then the P bet is returned to the player, and the B bet loses. On the other hand, if the next deal results in a B win, then the B bet is returned to the player, and the P bet loses. If, however, the next result is a tie (of any numerical total), either all "en prison" P and B bets win, all "en prison" P and B bets lose, all "en prison" P and B bets push, or all "en prison" P and B bets stay in action until there is a non-tie result. Each of these operating modes is viable and effects varying casino advantages.

In the "tie" proposition area 16, a player may wager on whether the "P" and "B" hands will result in a tie. This winning wager pays an amount higher than 1 to 1 , such as 8 to 1, for example, for an EVEN tie, or 9 to 1, for example, for an ODD tie. Additional proposition wagers could encompass ties with a particular number, one hand winning by a certain numerical value, or the like.

In playing the game, the dealer preferably deals a first card to each hand area 24, 26 and then a second card to each area. In an alternative variation, the dealer may also deal a third card to each hand area. The dealer then determines a numerical total and resolves the wagers according to the results of the game.

The game according to the invention is applicable to any game where a result is determined according to ranked values, such as Blackjack, War, Dice or an original ranked value game. In the dice version of the game, of course, the game equipment for establishing results of the first side ranking value and the second side ranking value includes one or more dice. The game could further be adapted to non-numerical games, provided results are determined according to some form of ranking (such as King higher than Queen or Bishop higher than Pawn or Warrior X higher than Warrior Y, etc.).

As would be apparent to those skilled in the relevant art, the invention can be embodied in a wide variety and forms of media, but not limited to, single player slot video machines, multi-player slot video machines, electronic games and devices, lottery terminals, scratch-card formats, software, as well as in-flight, home and Internet entertainment. In addition, the invention can be readily implemented as a computer program product (e.g., floppy disk, compact disk, etc.) comprising a computer readable medium having control logic recorded therein to implement the features of the invention as described in relation to the other preferred embodiments. Control logic can be loaded into the memory of a computer and executed by a central processing unit (CPU) to perform the operations described herein.

Figure 2:
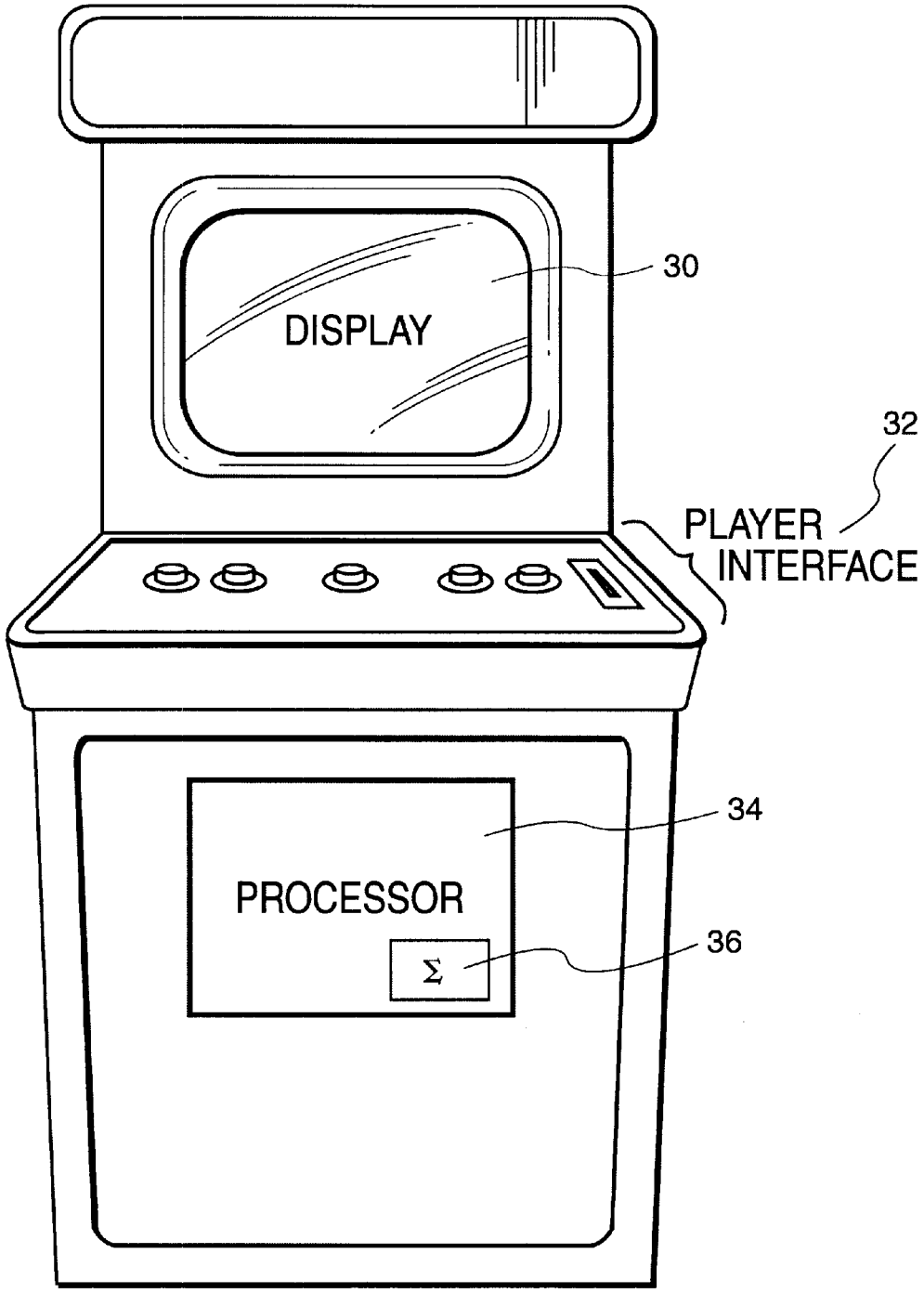
FIG. 2 is a schematic diagram illustrating the structure effecting game play according to the apparatus of the present invention.

In this context, referring to FIG. 2, a block diagram is illustrated showing the components of an apparatus configured for playing the game according to the invention. The apparatus includes a display 30, a player interface 32, and circuitry 34, 36 for effecting game play and including structure for establishing first side and second side ranking value results, such as dealing hands of cards, a summing circuit 36 that determines a ranking value of the results, and a processing circuit 34 effecting game play according to the rules of the game. The processing circuit then resolves wagers according to the ranking value results.

With the methodology according to the present invention, drawbacks associated with conventional Baccarat and the like can be eliminated, resulting in a more enjoyable and playable game that is suited for players of all levels. The elimination of card drawing rules increases the speed of play, eliminates player confusion, and avoids an inherent deterioration bias, while the casino operator can adjust a house advantage by determining rules for resolving ties.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A method of playing a game where a result is determined according to ranked values, the method comprising:

(a) receiving at least one wager that at least one of a plurality of events will occur, the plurality of events including (1) a first side having a higher ranking value than a second side, (2) the second side having a higher ranking value than the first side, and (3) the first side having a ranking value equal to the second side;

(b) adjusting a house advantage by determining rules for resolving ties;

(c) dealing two playing cards to each of the first side and the second side and determining a numerical total of each of the two playing cards according to predetermined rules of the game; and (d) resolving the at least one wager according to the respective numerical totals and the rules for resolving ties, wherein upon the occurrence of a tie, wagers for events (1) and (2) are pushed except for ties with a numerical value of zero.

2. A method according to claim 1, wherein upon the occurrence of a zero tie, step (d) is practiced by taking wagers on events (1) and (2).

3. A method according to claim 1, wherein upon the occurrence of a zero tie, step (d) is practiced by taking wagers on events (1) and (2) when the zero tie results from two zero-value cards for each of the first side and the second side and by paying 1 to 1 on wagers for events (1) and (2) when the zero tie results from any other combination of cards.

4. A method according to claim 1, wherein upon the occurrence of a zero tie, step (d) is practiced by taking half of the wagers on events (1) and (2).

5. A method according to claim 1, wherein upon the occurrence of a zero tie, step (d) is practiced by holding wagers on events (1) and (2) for a next deal of cards, and resolving said wagers on events (1) and (2) in the next deal of cards.

6. A method according to claim 5, wherein said wagers on events (1) and (2) held according to step (d) arc resolved in the next deal of cards according to the following:

(i) if the first side wins the next deal of cards, wagers on event (1) are returned and wagers on event (2) are taken;

(ii) if the second side wins the next deal of cards, wagers on event (2) are returned and wagers on event (1) are taken; and (iii) if a result of the next deal of cards is a tie, then said wagers on events (1) and (2) are resolved according to special rules.

7. A method according to claim 6, wherein if the result of the next deal of cards is a tie, the special rules comprise paying a payout on the held wagers for events (1) and (2).

8. A method according to claim 6, wherein if the result of the next deal of cards is a tie, the special rules comprise taking the held wagers for events (1) and (2).

9. A method according to claim 6, wherein if the result of the next deal of cards is a tie, the special rules comprise pushing the held wagers for events (1) and (2).

10. A method according to claim 6, wherein if the result of the next deal of cards is a tie, the special rules comprise further holding the held wagers for events (1) and (2) for another deal of cards.

11. A method according to claim 1, further comprising assigning playing cards having an indicia of a King, a Queen or a Jack a value of zero.

12. A method according to claim 1, further comprising, prior to step (a), preparing a deck of the playing cards by removing cards having an indicia of a King, a Queen or a Jack.

13. A method according to claim 1, further comprising declaring one of the first side and the second side having a higher numerical total to be the winner.

14. A method according to claim 13, wherein step (d) is practiced by paying 1 to 1 for wagers on events (1) and (2) and paying an amount higher than 1 to 1 for wagers on event (3).

15. A method according to claim 14, wherein step (d) is practiced by paying at least 8 to 1 for wagers on event (3).

16. A method according to claim 15, wherein step (d) is practiced by paying 8 to 1 for wagers on event (3) when the numerical total is an EVEN number and paying 9 to 1 for wagers on event (3) when the numerical total is an ODD number.

17. A method according to claim 1, further comprising counting values of ten as zero, and declaring one of the first side and the second side having a higher numerical total that is closer to nine to be the winner.

18. A method according to claim 1, wherein step (c) is practiced according to rules of Baccarat.

19. An apparatus configured for playing a game comprising:

means for receiving at least one wager that at least one of a plurality of events will occur, the plurality of events including (1) a first side having a higher ranking value than a second side, (2) the second side having a higher ranking value than the first side, and (3) the first side having a ranking value equal to the second side;

means for adjusting a house advantage by determining rules for resolving ties;

means for dealing two playing cards to each of the first side and the second side and for determining a numerical total of each of the two playing cards according to predetermined rules of the game; and means for resolving the at least one wager according to the respective numerical totals and the rules for resolving ties, wherein upon the occurrence of a tie, wagers for events (1) and (2) are pushed except for ties with a numerical value of zero.

20. A method of playing a game where a result is determined according to ranked values, the method comprising:

(a) receiving at least one wager that at least one of a plurality of events will occur, the plurality of events including (1) a first side having a higher ranking value than a second side, (2) the second side having a higher ranking value than the first side, and (3) the first side having a ranking value equal to the second side;

(b) dealing two playing cards to each of the first side and the second side and determining a numerical total of each of the two playing cards according to predetermined rules of the game; and (c) resolving the at least one wager according to the respective numerical totals, wherein upon the occurrence of a tie, wagers for events (1) and (2) are pushed except for ties with a numerical value of zero, wherein upon the occurrence of a zero tie, step (c) is practiced by one of:

taking wagers on events (1) and (2), taking wagers on events (1) and (2) when the zero tie results from two zero-value cards for each of the first side and the second side and paying 1 to 1 on wagers for events (1) and (2) when the zero tie results from any other combination of cards, taking half of the wagers on events (1) and (2), and holding wagers on events (1) and (2) for a next deal of cards, and resolving said wagers on events (1) and (2) in the next deal of cards.

21. A method according to claim 20, wherein said wagers on events (1) and (2) held according to step (c) are resolved in the next deal of cards according to the following:

(i) if the first side wins the next deal of cards, wagers on event (1) are returned and wagers on event (2) are taken;

(ii) if the second side wins the next deal of cards, wagers on event (2) are returned and wagers on event (1) are taken; and (iii) if a result of the next deal of cards is a tie, then said wagers on events (1) and (2) are resolved according to special rules.

22. A method according to claim 21, wherein if the result of the next deal of cards is a tie, the special rules comprise paying a payout on the held wagers for events (1) and (2).

23. A method according to claim 21, wherein if the result of the next deal of cards is a tie, the special rules comprise taking the held wagers for events (1) and (2).

24. A method according to claim 21, wherein if the result of the next deal of cards is a tie, the special rules comprise pushing the held wagers for events (1) and (2).

25. A method according to claim 21, wherein if the result of the next deal of cards is a tie, the special rules comprise further holding the held wagers for events (1) and (2) for another deal of cards.

26. A method of playing a game where a result is determined according to ranked values, the method comprising:

(a) receiving at least one wager that at least one of a plurality of events will occur, the plurality of events including (1) a first side having a higher ranking value than a second side, (2) the second side having a higher ranking value than the first side, and (3) the first side having a ranking value equal to the second side;

(b) adjusting a house advantage by determining rules for resolving ties;

(c) dealing two playing cards to each of the first side and the second side and determining a numerical total of each of the two playing cards according to predetermined rules of the game; and (d) resolving the at least one wager according to the respective numerical totals and the rules for resolving ties, wherein, (1) upon the occurrence of a tie for numerical totals of 2, 4, 6 or 8, wagers on events (1) and (2) are paid 1 to 1, (2) upon the occurrence of a tie for numerical totals of 1, 3, 5, 7 or 9, wagers on events (1) and (2) are taken, and (3) upon the occurrence of a tie for a numerical total of zero, wagers on events (1) and (2) are pushed.

* * * * *